United States Patent [19]

Ziaylek, Jr.

[11] 4,391,377

[45] Jul. 5, 1983

[54] KNOCK-DOWN ASSEMBLY FOR SUPPORTING OXYGEN TANKS

[76] Inventor: Theodore Ziaylek, Jr., P.O. Box 292, Yardley, Pa. 19067

[21] Appl. No.: 245,408

[22] Filed: Mar. 19, 1981

[51] Int. Cl.[3] ..... A47F 7/28

[52] U.S. Cl. ..... 211/71; 211/13; 211/194; 206/443; 410/49

[58] Field of Search ..... 211/13, 71, 194, 74, 211/188; 248/146, 150; 410/49; 206/319, 443, 386; 108/55.3, 55.1

[56] References Cited

U.S. PATENT DOCUMENTS

| | | | |
|---|---|---|---|
| 2,632,567 | 3/1953 | Richtmyer | 211/13 |
| 3,392,682 | 7/1968 | Francis | 410/49 X |
| 3,602,368 | 8/1971 | Gould | 211/71 X |
| 3,635,354 | 1/1972 | Martin | 52/610 X |
| 3,643,814 | 2/1972 | Martin | 52/610 X |
| 4,060,174 | 11/1977 | Gerhard | 410/49 X |
| 4,175,666 | 11/1979 | Smith | 211/71 |

FOREIGN PATENT DOCUMENTS

| | | | |
|---|---|---|---|
| 1524946 | 5/1968 | France | 211/188 |

*Primary Examiner*—Ramon S. Britts
*Assistant Examiner*—Robert W. Gibson, Jr.
*Attorney, Agent, or Firm*—Frederick A. Zoda; John J. Kane; Albert Sperry

[57] ABSTRACT

A quickly assembled rack for supporting oxygen tanks and other cylindrical objects is disclosed, requiring no special tools and comprising relatively few components, adapted to be assembled in any of a wide variety of rack configurations. The assembly basically constitutes a plurality of rack sections each of which supports a single tank. Each section is comprised, essentially, of a three-sided box portion, a tank-supporting cradle adapted to be mounted therein, and a cover plate for the box section. By selective positioning of the box sections, any of various rack assemblies, extending in tiers for any selected horizontal or vertical distance, can be quickly erected, and knocked down with equal facility for storage or shipment. When a tiered assembly is desired, the bottom of one box section becomes the cover for the section below the same. Openings in the sides and bottoms of the box sections are so placed as to automatically register with corresponding openings of adjacent sections adjacent to or below each section, to receive fasteners, whereby the entire assembly can be securely locked in both the horizontal and vertical direction, against relative movement of one box section in respect to any of the other sections of the rack assembly.

It is also possible, if desired, to so erect the assembly as to allow the tanks to be stored in vertical positions rather than in positions approaching or at the horizontal.

8 Claims, 7 Drawing Figures

KNOCK-DOWN ASSEMBLY FOR SUPPORTING OXYGEN TANKS

BACKGROUND OF THE INVENTION

1. Field of the Invention

The invention relates generally to the field of support devices, and more particularly to quickly erected or knocked-down rack assemblies for objects such as oxygen tanks or the like. Devices of this type are used, for example, by fire or rescue squads, as means for supporting oxygen tanks used in breathing apparatus. Heretofore, it has been difficult to provide rack assemblies of this nature, because of the difficulty in locating and erecting racks designed for particular storage areas, some of which are in fire or rescue vehicles, and others of which may be permanently located in the equipment storage areas of the fire companies or the rescue squads. Some fire companies or rescue squads may require only limited storage areas, for storing a comparatively few tanks. Others may require greater areas, and heretofore, assemblies that can be tailor-made, so to speak, according to the requirements of the particular fire or rescue squads have not been obtainable except at relatively high cost. It is important, thus, to provide devices of this type that can be comprised of a basically few, simple components, and that can be of modular construction and arrangement, to permit the rack assemblies to be assembled in any configuration, and in such a way as to support a particular number of tanks, according to the needs of the purchaser.

2. Description of the Prior Art

The prior art has, it is true, suggested broadly the concept of modular, knock-down racks, as shown for example by the patent to Martin, U.S. Pat. No. 3,643,814. However, this patent and other patents known to me have not been particularly adapted for supporting oxygen tanks, in a manner to permit racks to be assembled in rigidly secured, stationary, strong arrangements that will resist heavy vibrations on emergency vehicles, while at the same time supporting the oxygen tanks in a cushioned fashion, to prevent the tanks from being damaged or dislodged by shocks encountered during a fast emergency run of the rescue vehicle or fire truck.

SUMMARY OF THE INVENTION

Summarized briefly, the invention comprises a plurality of box-like sections, each of which is adapted to support a single oxygen tank. The sections can be erected in tiers, wherein there may be any desired number of horizontal rows, in a superposed arrangement, with any number of sections being utilized for the horizontal rows, according to the desires or needs of the user. In this way the rack assembly can occupy a particular area of a fire truck or other emergency vehicle, which area is obviously one that will vary from one vehicle to another, but which can be utilized to the maximum extent by filling the same with a rack comprised of all the box-like sections that will be capable of fitting properly into said area.

Each section essentially comprises a three-sided box portion, which may be considered as including a base or web part, integral with sidewalls having inwardly directed mounting flanges.

A cradle particularly designed for supporting an oxygen tank is adapted to be mounted within the box portion adjacent the base, and has mounting lips or flanges adapted to be secured to the opposed sidewalls. The cradle includes selectively locatable cushions or shock absorbent pads, adapted to protect the supported tank against heavy shocks encountered during operation of an associated emergency vehicle, and also adapted to support the tank in a cushioned fashion in a rack that may be mounted in a building rather than upon an emergency vehicle.

In erecting a rack, the mounting of one box section upon another causes the bottom or web portion of the upper box section to become the cover plate for the section next below the same. When a plurality of sections have been mounted in superposed relation in this way, the cover plate is utilized for the uppermost section to close it at its top.

In this way, it will be seen that each box section essentially comprises the box portion briefly summarized above, the cradle, and a cover plate. Additionally, it is desirable to provide a backstrap or retaining means for preventing the tank from sliding out of the box section, and it is also desirable to provide means for securing each box section fixedly not only to the section next below the same, but also to sections immediately above and to either side thereof. This makes for a strong, rigid rack, which holds the tanks very securely despite the fact that it is made of a few relatively simple parts capable of being assembled without the need of special tools or the like.

Also incorporated in the construction is an arrangement wherein the means for connecting like box sections in side-by-side relationship is utilized as the same means for mounting the cradles in the respective sections.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENTS

Essentially, the invention comprises a modular rack adapted to be erected or knocked down with maximum speed and ease, and without requirement of using special tools or skilled labor. The rack assembly comprises one or more box sections such as that shown in FIG. 4. There is here illustrated a box section 10 including a main or box portion 12 which can be formed from a single piece of sheet metal material, bent to include a flat base or web portion 14 integral along its opposite side edges with opposed, parallel sidewalls 16 disposed in planes normal to that of the web portion. The base and web portions can be of any length desired, and would normally be of a length slidably less than the length of a supported tank T, so that the head of the tank may project out of the head end of the box section in the manner shown in FIG. 2, thus facilitating storing or the removal of the supported tank or tanks.

Figure 4:
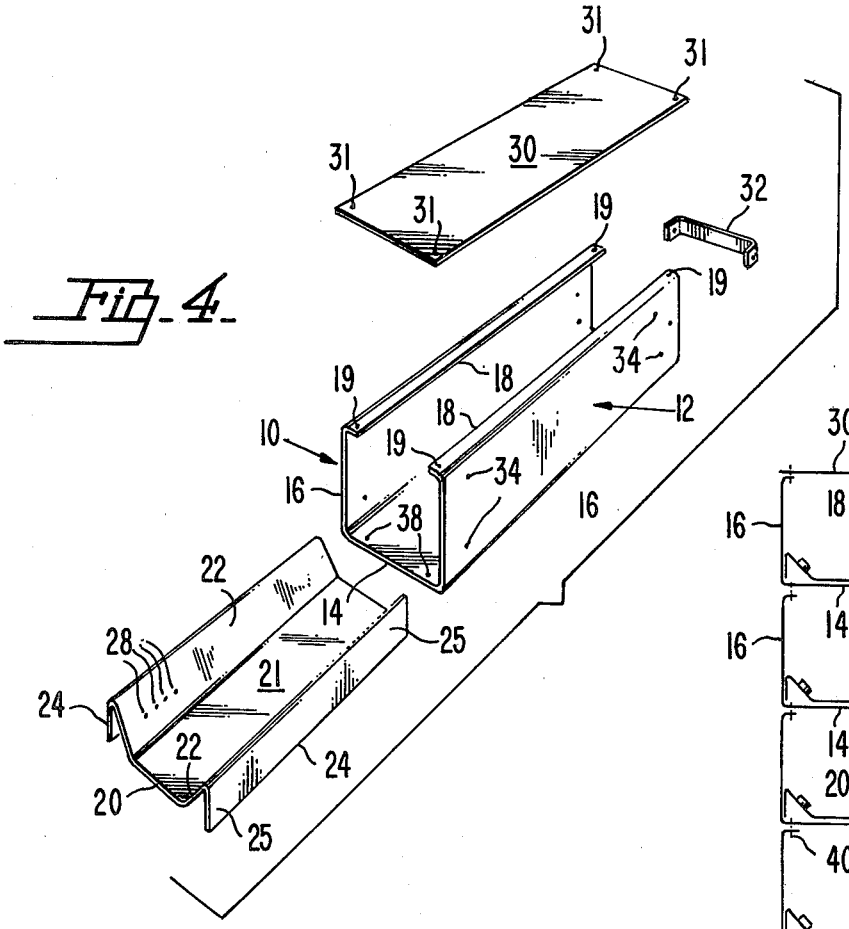
FIG. 4 is an exploded perspective view of one of the box sections per se.

The sidewalls 16 are formed, along the longitudinal edges thereof remote from the web portion 14, with inwardly directed, co-planar mounting flanges 18. The mounting flanges 18, as shown in FIG. 4, have openings 19 adjacent the respective ends thereof.

Adapted to be assembled with the box portion 12 is a tank support cradle 20. This, like the box portion, can be readily fashioned from a single piece of sheet metal material, including a main portion 21 the length of which is slightly less than that of the box portion, so as to cause the tank support cradle to terminate, at its respective ends, short of the adjacent ends of the box portion (see FIG. 2).

Main portion 21 of each cradle is integral, along its respective longitudinal edges, with oppositely inclined, upwardly divergent walls 22 which are integral, along their outer longitudinal edges, with oppositely bent mounting flanges or lips 24 having, adjacent their ends, apertures 25.

Figure 1:
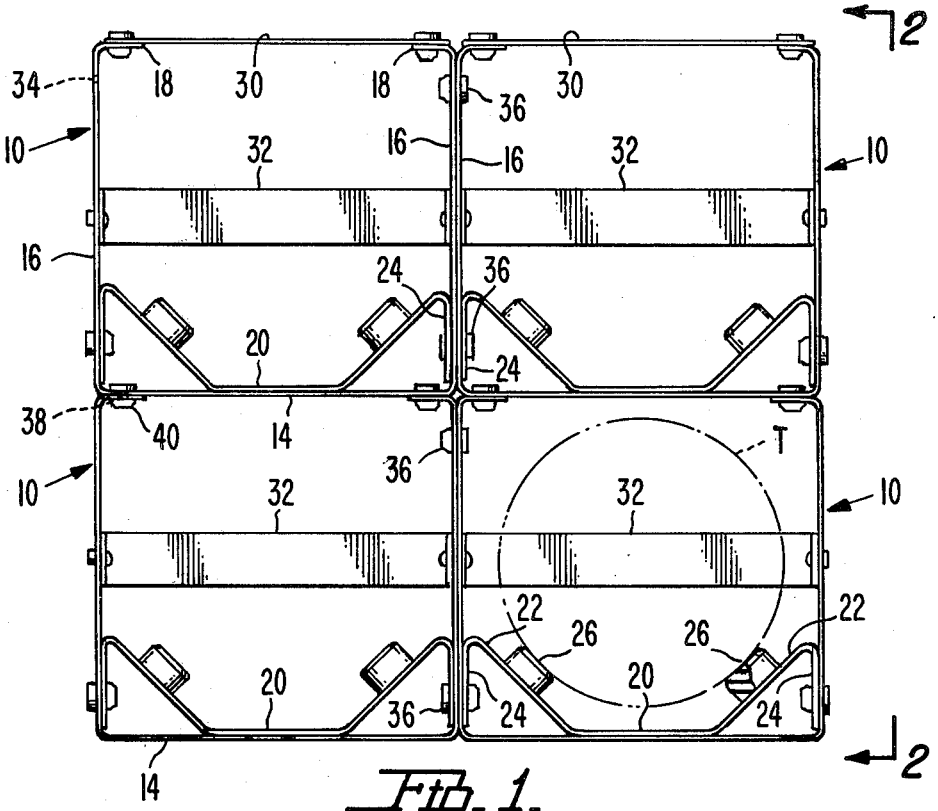
FIG. 1 is a view showing four of the box sections mounted in a simple rectangular configuration, a supported oxygen tank being illustrated in dotted lines in one of the box sections, the sections being shown as they appear when viewed from the head end thereof.
Figure 2:
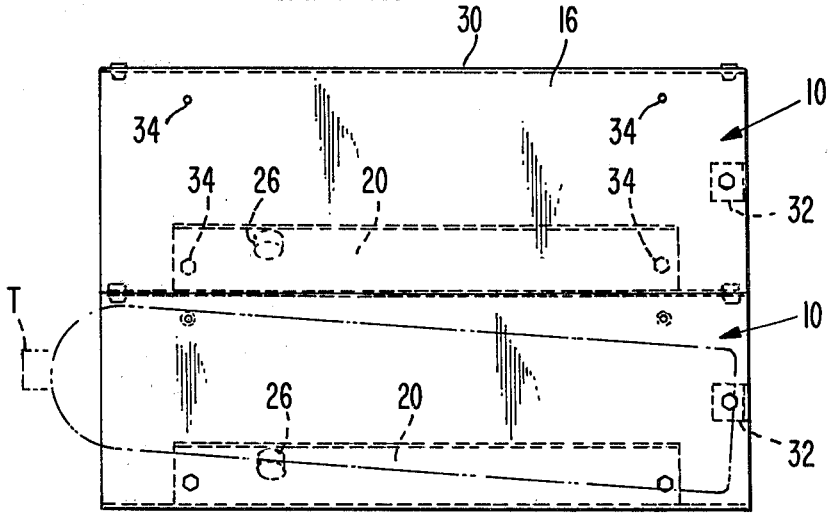
FIG. 2 is a side elevational view of the FIG. 1 rack assembly, on a reduced scale, as seen from line 2—2 of FIG. 1.

Referring to FIGS. 1 and 2, it will be seen that I provide, on the forward or head end portions of the cradles, soft rubber cushions or pads 26. These are mounted upon the inclined walls 22, and thus supportably engage the head end portion of a tank T in the manner shown in FIG. 2. The tank is thus supported, for its entire length, out of contact with adjacent pieces of metal or the like, that might tend to damage the tank or, for that matter, the rack itself. The tank, by reason of the pads 26, it supported in a position slightly inclined from the horizontal as shown in FIG. 2, when the box portions of the rack are disposed in horizontally extending positions. This, it may be noted, would be their normal configuration, although it is indeed possible, in a manner to be described hereinafter, that the tanks might also be supported vertically.

In any event, the tanks when so supported are readily accessible from the head ends of the rack, since it would be normal for a supported tank to project a short distance beyond the head end of the box portion in which it is engaged, as shown in FIG. 2.

It may be observed, in this connection, that the supported tank may be of a particular length and diameter, different from those of another tank that could be supported with equal facility by the rack. To this end, the inclined walls 22 of the cradle have an entire series of longitudinally spaced openings 28, adapted to receive studs or other mounting means, not shown, extending from the pads 26. This permits adjustable positioning of the pads along the length of the cradle, according to the particular desires of the user as to the extent to which the tank is to be inclined from the horizontal, a decision which might also be affected by the particular circumference or length of the tank, as will be readily noted.

Completing the construction of the basic box section, in the sense of closing all four sides of it, is a flat cover plate 30 having openings in its several corners as shown at 31. These openings register with the openings 19 of the flanges 18. It may also be noted, in this regard, that the box section also includes a backstrap 32, which is secured to and extends across the back end of the box section (see FIGS. 1 and 2) to engage the base of the supported tank T.

Referring to FIG. 4, also formed in the respective sidewalls 16 of the main or box portion 14 is a rectangular series of openings 34, adapted to register with corresponding openings of the next adjacent box section. Thus, in erecting a rack assembly, adjacent box sections would be positioned as shown in FIG. 1, in a side-by-side relationship, with their adjacent sidewalls 16 in direct, face-to-face contact, to permit insertion of connecting means 36. The connecting means 36 would normally in a typical arrangement, be a simple bolt and nut, extending through the registered openings 34 of the contacting sidewalls 16 to connect the side-by-side box sections fixedly together.

Similarly, the arrangement permits secure fixed connection of superposed box sections to each other. As will be noted from FIG. 1, whenever a box section is disposed directly above another box section, the cover plate 30 of the lower section is left off, since the upper box section closes the top of the lower section. In these circumstances, apertures 38 of the web part 14 of the upper section register with apertures 19 of the inwardly directed mounting flanges 18 of the lower section to receive connecting bolt and nut means 40.

In this way, a rack can be built up in horizontal and vertical directions, to any extent desired, and in every instance, all of the box sections are securely fixedly attached, without the need of skilled labor or the use of special tools, to one another.

Figure 5:
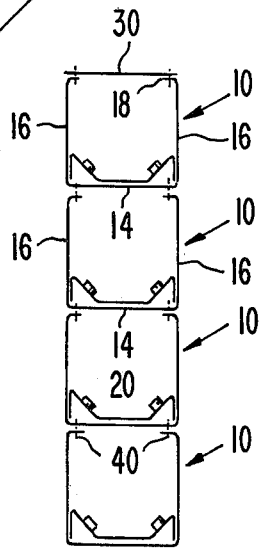
FIG. 5 is a somewhat diagramatic view showing a single vertical stack of sections.
Figure 6:
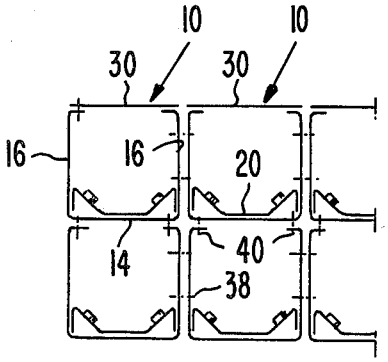
FIG. 6 is a view like FIG. 5 showing a fragmentary portion of another possible configuration for a rack, wherein two rows of box sections extend horizontally, one above the other.

One can build any of various types of racks, and this is shown by way of example in FIGS. 5 and 6. In FIG. 5 a rack comprising a single vertical stack of box sections is provided, with the cover plate 30 being applied to the uppermost section. In FIG. 6 a rack comprising superposed, horizontally extending rows of box sections is illustrated. Again, the cover plates are applied to the uppermost sections.

It will be readily apparent that any of a wide variety of racks can be provided, including racks that are stepped, racks that are low in height but are of substantial horizontal extension, and racks that conversely, are of substantial vertical dimension while of relatively low horizontal extent, together with racks that are of substantial dimension both in the vertical and the horizontal directions.

Figure 3:
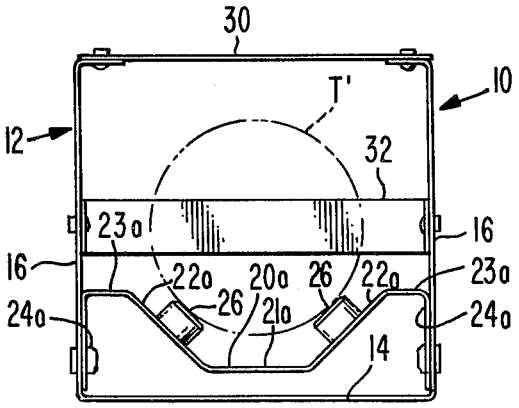
FIG. 3 is a view of a modified construction, a single box section being illustrated, the modification residing in the cradle used for supporting the tank.

In FIG. 3 there is shown a box section which is identical to those that have been heretofore illustrated and described in every respect except for the cradle. In this form of the invention the cradle is designed to support a tank of substantially smaller diameter than the tank T. Accordingly, the cradle **20*a* includes a main portion 21*a* integral with upwardly divergent sidewalls 22*a* on which are mounted pads 26. The main portion 21*a* is relatively narrow as compared to the main portion of the cradle 20. Accordingly the pads 26** are spaced a substantially shorter distance apart in the transverse direction, than is true of the pads in the first form of the invention. This permits the support of a tank T' having a circumference much less than that of the tank T.

One may very possibly utilize cradles 20 and 20*a* at different locations in the same rack assembly, so that the rack can support tanks of different diameters.

Figure 7:
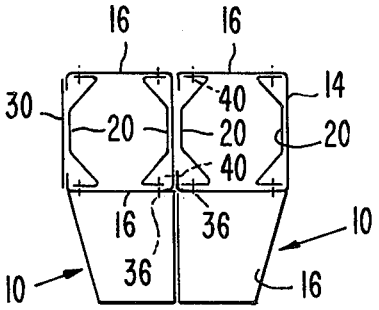
FIG. 7 is a somewhat schematic, perspective view showing a pair of the box sections arranged for supporting the tanks vertically.

In the illustrated examples of the use of the device comprising the present invention, the box sections have been illustrated in horizontal positions, so as to support the tanks in positions in which they are inclined slightly from the horizontal but are basically disposed in generally horizontal positions. Alternatively, the tanks can be supported vertically. In this event, an arrangement as shown in FIG. 7 would be used. When assembling the rack for vertical placement of the tanks, two cradles are used in each box. Bumpers or pads 26 are not employed. As shown in FIG. 7, the adjacent box sections are connected together in the same manner as the superposed sections are connected in FIG. 1, and a cover plate 30 is applied to close the open side of the box section at the end of the assembly.

By use of the opposed cradles in each box section, tanks can be supported in vertical positions, an arrangement which may be desired in some instances and which is permitted by use of the modular arrangement herein before illustrated and described, requiring merely an extra cradle in each box section.

As will be noted, the modular arrangement is achieved through the provision of box sections which comprise relatively few parts, readily fashioned from sheet metal and readily assembled without the need of special tools. Yet, despite the use of a few simple parts, the rack assembly can be built up in a wide variety of configurations and is adapted to support tanks or similar cylindrical objects in either vertical or generally horizontal positions, as dictated by the needs or desires of the particular user.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A rack assembly for supporting oxygen tanks and like cylindrical objects, comprising:

(a) a plurality of box sections each of which is of rectangular, three-sided form with one open side and includes a web portion and a pair of sidewall portions extending therefrom, said sections being adapted to be disposed in longitudinally contacting relation;

(b) at least one cradle mounted in each section and adapted to supportably engage an oxygen tank, the web portions of some of the sections closing the open side of adjacent sections;

(c) a cover plate closing the open side of the remaining sections; and (d) connecting means extending between and fixedly secured together those sections disposed in longitudinally contacting relation.

2. A rack assembly as in claim 1 wherein each box section has mounting flanges extending along the sidewalls thereof, said mounting flanges being adapted to receive the connecting means of adjacent sections.

3. A rack assembly as in claim 1 wherein each cradle is formed with a main portion and with sidewalls extending in diverging relation from said main portion.

4. A rack assembly as in claim 3 wherein each cradle further includes resilient cushions mounted on the divergent sidewalls thereof.

5. A rack assembly as in claim 3 wherein each cradle further includes mounting lips on the divergent sidewalls adapted to be secured to adjacent sidewalls of a box section in which the cradle is received.

6. A rack assembly as in claim 1, further including a backstrap extending across one end of each box section to engage one end of a tank supported in the box section.

7. A rack assembly as in claim 1 wherein each box section further includes mounting flanges on the sidewalls thereof, the web portions and mounting flanges having registering openings, whereby the web portions can be secured to the mounting flanges of adjacent box sections by said connecting means.

8. A rack assembly as in claim 7 wherein the sidewalls of adjacent box sections have registering openings, the cradles having mounting openings in registration with the registered openings of said sidewalls of adjacent sections, whereby adjacent sections can be secured together by a connecting means serving at the same time as means for securing cradles in the box sections.

* * * * *